US010468799B2

(12) United States Patent
Xiao et al.

(10) Patent No.: US 10,468,799 B2
(45) Date of Patent: Nov. 5, 2019

(54) ELECTRICAL CONNECTOR WITH FLEXIBLE PRINTED CIRCUITS

(71) Applicant: FOXCONN INTERCONNECT TECHNOLOGY LIMITED, Grand Cayman (KY)

(72) Inventors: Xiang Xiao, Kunshan (CN); Wei Zhong, Kunshan (CN); Jian-Kuang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/998,713

(22) Filed: Aug. 16, 2018

(65) Prior Publication Data

US 2019/0058273 A1 Feb. 21, 2019

(30) Foreign Application Priority Data

Aug. 16, 2017 (CN) ..... 2017 1 0699516

(51) Int. Cl.

| | |
|---|---|
| ***H01R 12/77*** | (2011.01) |
| ***H01R 12/70*** | (2011.01) |
| *H01R 43/20* | (2006.01) |
| *H01R 4/02* | (2006.01) |
| *H01R 12/65* | (2011.01) |

(52) U.S. Cl.

CPC ..... *H01R 12/774* (2013.01); *H01R 12/707* (2013.01); *H01R 12/775* (2013.01); *H01R 4/023* (2013.01); *H01R 12/65* (2013.01); *H01R 43/205* (2013.01)

(58) Field of Classification Search

CPC ... H01R 12/774; H01R 43/205; H01R 12/775
USPC ..... 439/77, 79
See application file for complete search history.

(56) References Cited

U.S. PATENT DOCUMENTS

| | | | | |
|---|---|---|---|---|
| 3,149,896 A * | 9/1964 | Hall | H01R 12/79 | 439/329 |
| 5,112,234 A * | 5/1992 | Johnson | H01R 43/205 | 29/837 |
| 5,833,475 A * | 11/1998 | Mitra | H01R 43/20 | 439/79 |
| 5,885,100 A * | 3/1999 | Talend | G02B 6/4292 | 439/490 |

(Continued)

FOREIGN PATENT DOCUMENTS

| | | |
|---|---|---|
| CN | 203326174 U | 12/2013 |
| CN | 203747082 U | 7/2014 |

*Primary Examiner* — Neil Abrams
(74) *Attorney, Agent, or Firm* — Wei Te Chung; Ming Chieh Chang

(57) ABSTRACT

An electrical connector including an insulative housing, a plurality of contacts retained in the housing. The housing forms a mating surface for mating with an electronic part, and a supporting/mounting surface on which an FPC is seated. The contact includes a contacting section exposed upon the mating surface, a soldering section extending through the FPC, and a connecting section between the contacting section and the soldering section. A metallic shell is attached upon the housing, facing the FPC direction in the vertical direction to restrict movement of the FPC in a vertical direction. The contacts may be bent after assembly to expose the soldering sections at the mounting face.

19 Claims, 7 Drawing Sheets

(56) References Cited

U.S. PATENT DOCUMENTS

| | | | | |
|---|---|---|---|---|
| 6,287,151 | B1 * | 9/2001 | Matsuzaki | H01R 43/205 439/630 |
| 7,381,064 | B2 * | 6/2008 | Bolen | H01R 12/592 174/117 FF |
| 7,896,688 | B2 * | 3/2011 | Sukegawa | H01R 13/447 439/494 |
| 7,967,639 | B1 * | 6/2011 | Huang | H01R 13/6594 439/607.35 |
| 8,251,713 | B2 * | 8/2012 | Lin | H01R 13/2442 439/71 |
| 9,088,084 | B2 * | 7/2015 | Liao | H01R 13/41 |
| 9,331,439 | B2 * | 5/2016 | Qian | H01R 24/60 |
| 2019/0058273 | A1 * | 2/2019 | Xiao | H01R 12/774 |

* cited by examiner

ELECTRICAL CONNECTOR WITH FLEXIBLE PRINTED CIRCUITS

BACKGROUND OF THE INVENTION

1. Field of the Invention

The invention relates to the electrical connector assembly, particularly to the electrical connector equipped with the flexible printed circuits (FPC).

2. Description of Related Art

The China Utility Patent No. CN203747082U discloses an electrical connector adapted to be connected to an FPC via the soldering tails of the contacts. Because the soldering tails lack the sufficient support and protection, the connection between the soldering tails and the corresponding FPC may be influenced if an external impact is imposed thereon.

It is desired to have the electrical connector equipped with the metal latch which does not scrap the surface of the memory module.

SUMMARY OF THE INVENTION

An electrical connector including an insulative housing, a plurality of contacts retained in the housing. The housing forms a mating surface for mating with an electronic part, and a supporting/mounting surface on which an FPC is seated. The contact includes a contacting section exposed upon the mating surface, a soldering section extending through the FPC, and a connecting section between the contacting section and the soldering section. A metallic shell is attached upon the housing, facing the FPC direction in the vertical direction to restrict movement of the FPC in a vertical direction.

The method of making the electrical connector includes steps of: (1) providing an insulative housing with a mating surface and a supporting/mounting surface; (2) assembling a plurality of contacts into the housing from the mating surface: (3) bending the soldering sections of the contacts so as to not only prevent withdrawal of the contacts but also extend to the supporting surface; (4) positioning an FPC upon the supporting surface to be soldered to the soldering sections of the contacts: assembling a metallic shell to the housing for not only reinforcing the housing but also restricting movement of the FPC relative to the housing in a vertical direction.

Other objects, advantages and novel features of the invention will become more apparent from the following detailed description when taken in conjunction with the accompanying drawings.

DETAILED DESCRIPTION OF THE PREFERRED EMBODIMENT

Figure 1:
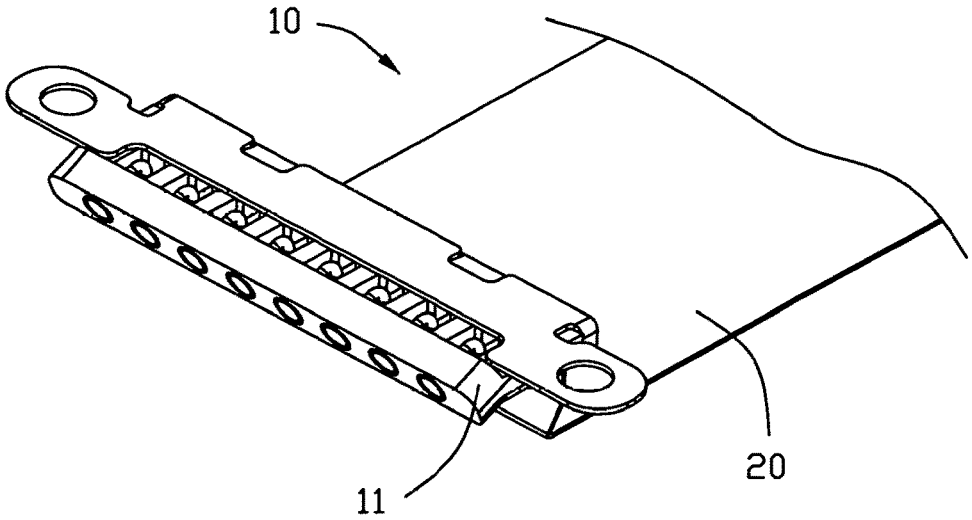
FIG. 1 is a perspective view of an electrical connector associated with an FPC according to the invention.
Figure 2:
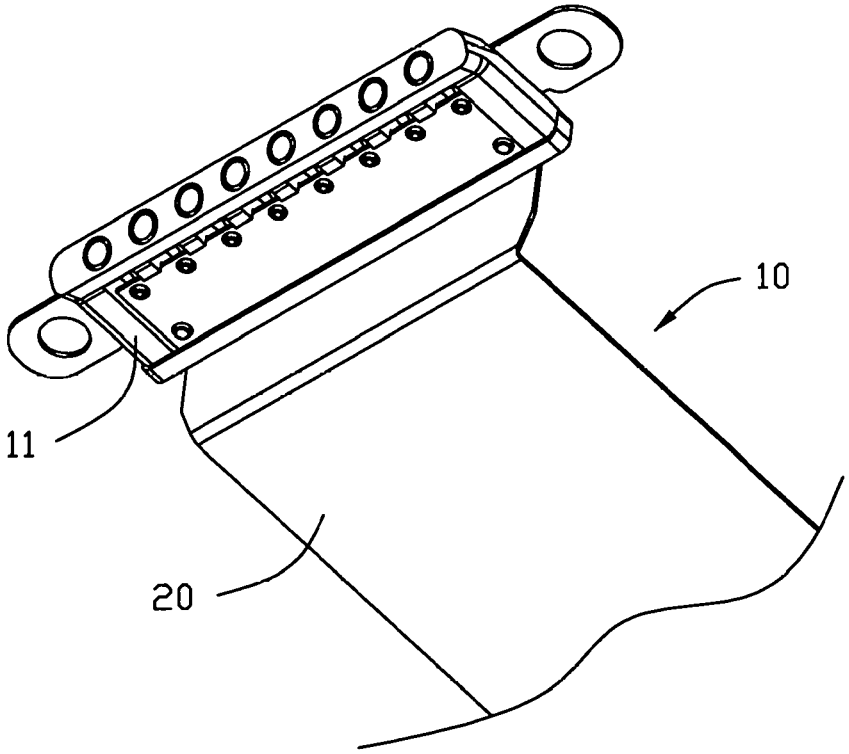
FIG. 2 is another perspective view of the electrical connector with FPC of FIG. 1.
Figure 3:
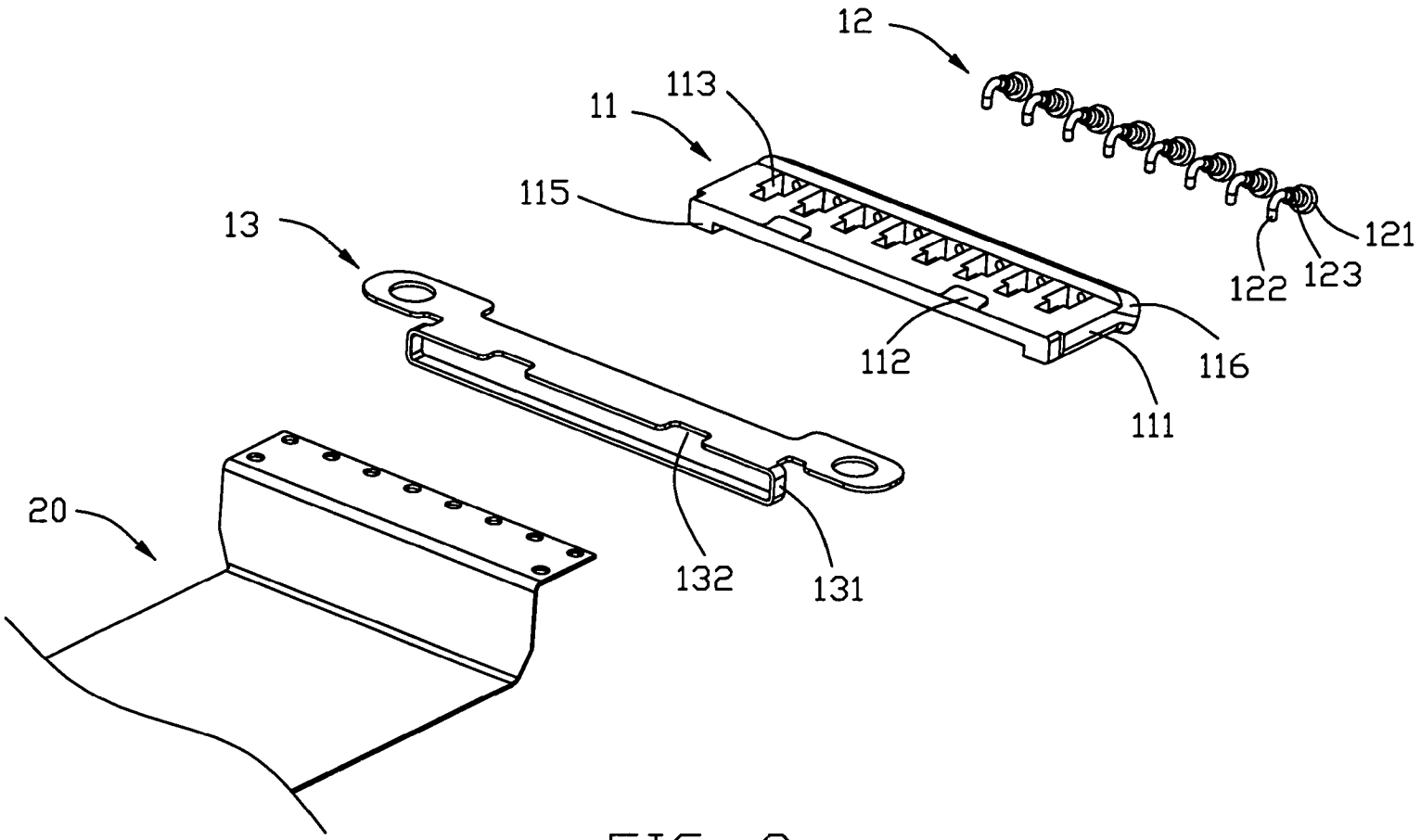
FIG. 3 is an exploded perspective view of the electrical connector and the FPC of FIG. 1.
Figure 4:
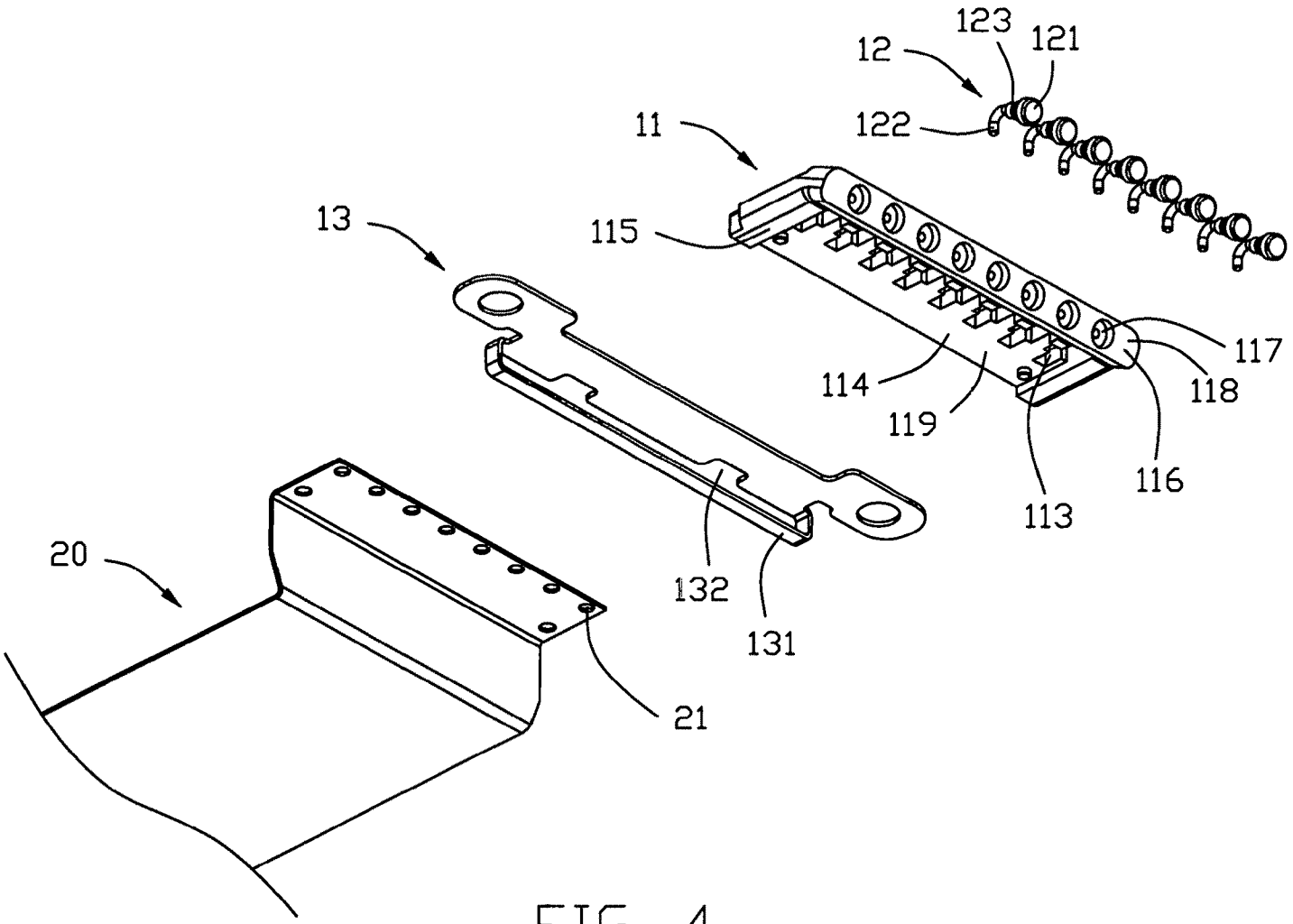
FIG. 4 is another exploded perspective view of the electrical connector and the FPC of FIG. 2.
Figure 5:
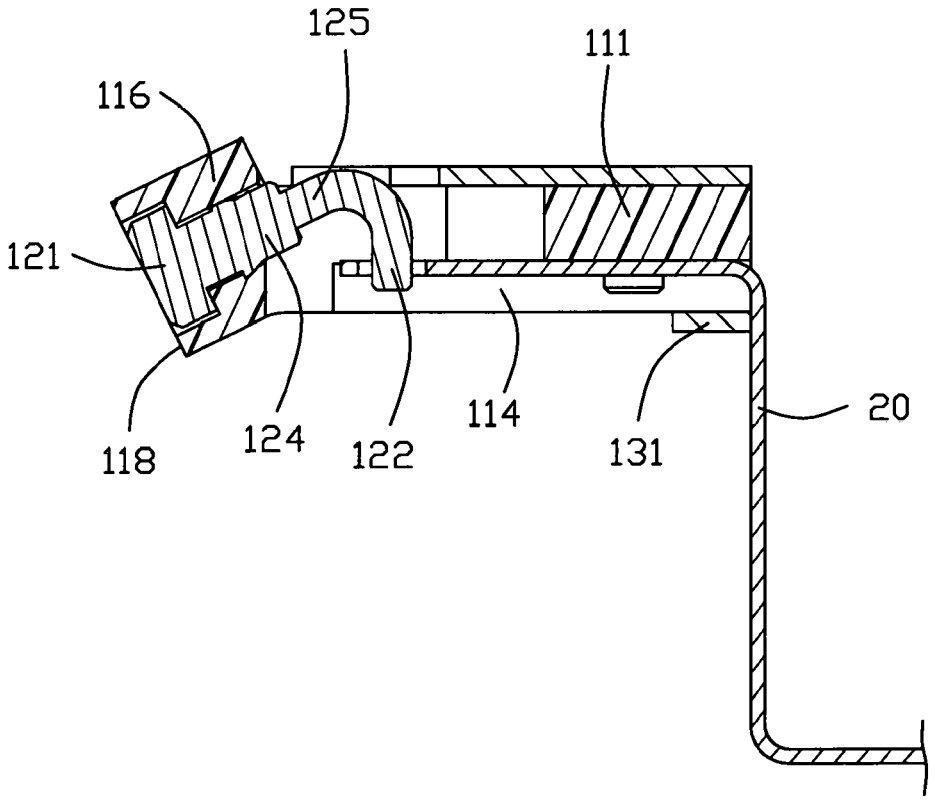
FIG. 5 is a cross-sectional view of the electrical connector with the FPC of FIG. 1.
Figure 6:
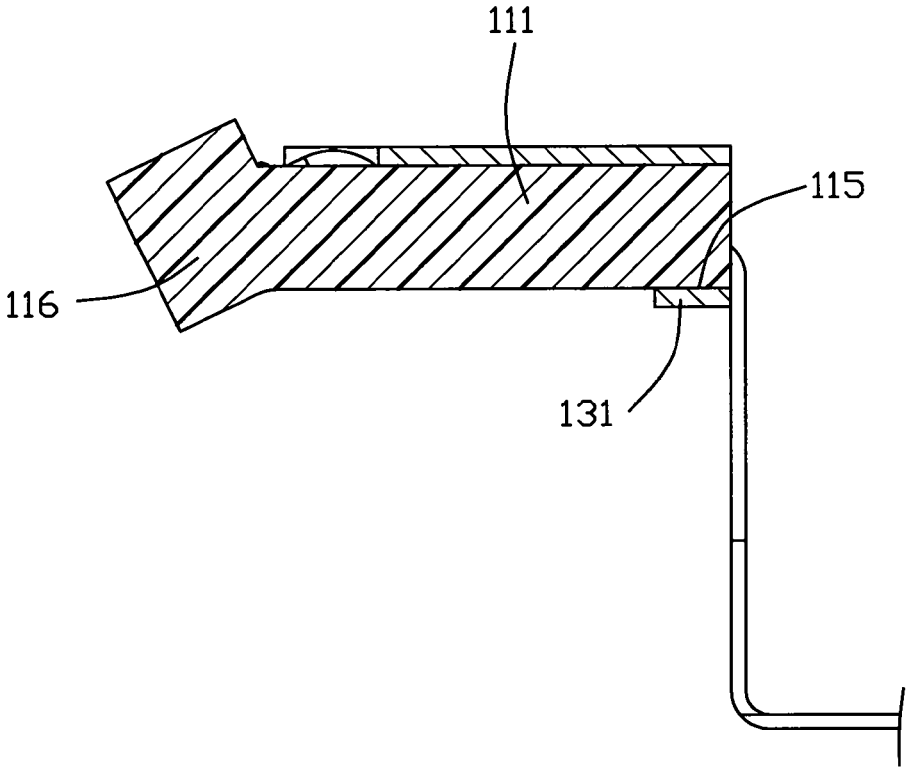
FIG. 6 is another cross-sectional view of the electrical connector and FPC of FIG. 1.
Figure 7:
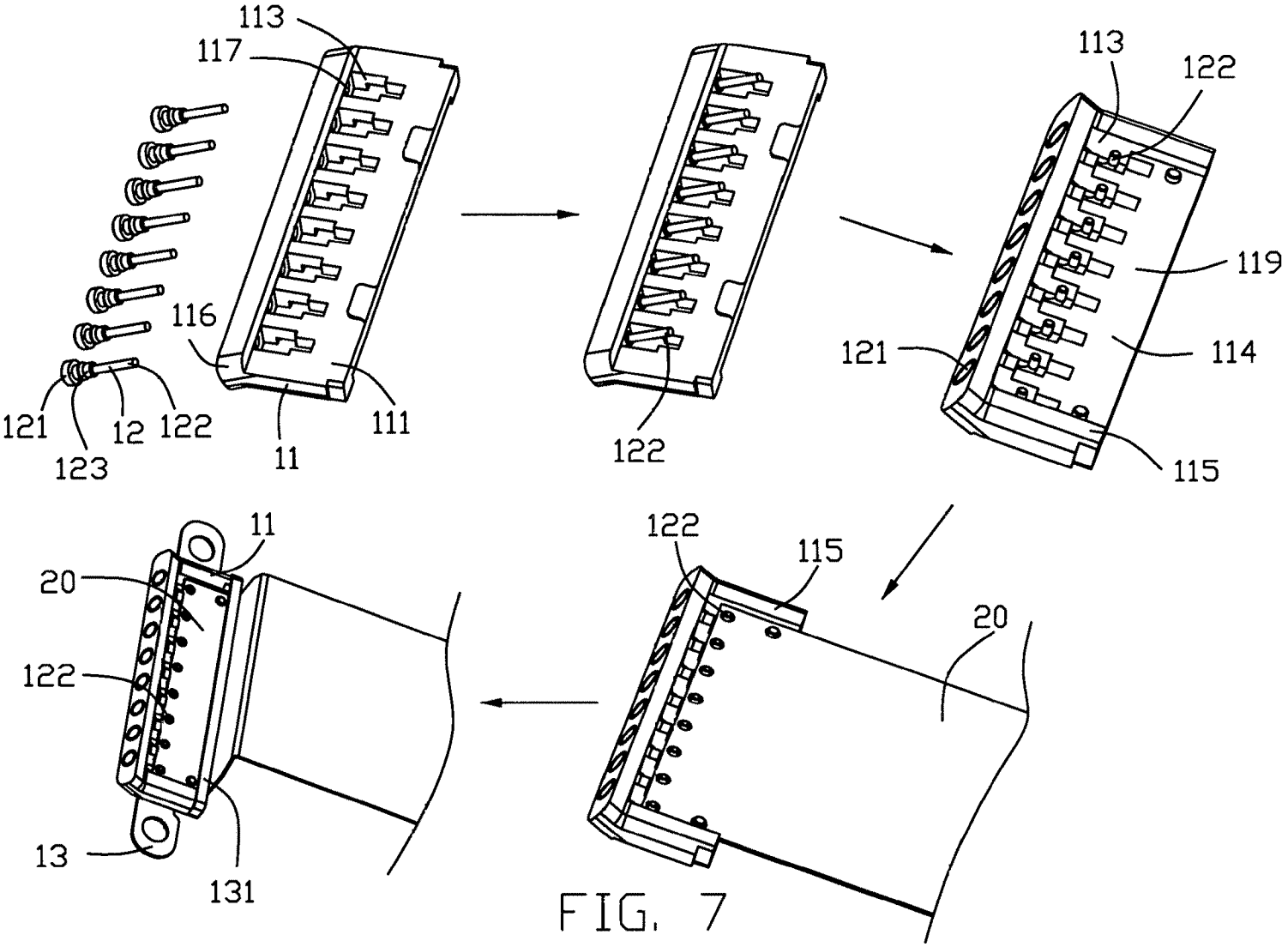
FIG. 7 is a diagram to show the assembling process of the electrical connector and the FPC of FIG. 1.

Referring to FIGS. 1-7, an electrical connector 10 includes an insulative housing 11, a plurality of contacts 12 retained in the housing 11, and a metallic shell 13.

The housing 11 defines a mating surface 118 on a front side and a supporting surface 119 on a rear side to support an FPC 20 thereon. The housing 11 includes a main body 111, and an oblique/mating section 116 extending forwardly from the main body 111. The mating surface 118 is formed on a front end of the oblique section 116. A plurality of through holes 117 are formed in the oblique section 116. A plurality of passageways 113 is formed in a front portion of the main body 111, each passageway 113 has a large front section and a small rear section. A rear portion of the main body 111 further forms a recess 114 between two opposite walls 115. The supporting surface 119 is formed on the bottom surface of the recess 114. The shell 13 includes a frame section 131 grasping the walls 115. The main body 111 forms the retention blocks 112 to fixedly receive the corresponding notches 132 in the frame section 131 for securing the shell 13 to the housing 11 without risks of withdrawal.

The contact 12 includes the contacting section 121 retained in the through hole 117 and exposed upon the mating surface 118, a soldering section 122 exposed upon the supporting surface 119, and a connecting section 123 linked between the contacting section 121 and the soldering section 122. The connecting section 123 includes a first bending section 124 and a second bending section 125. The first bending section 124 is received in the oblique section 116 while the second bending section 125 is received within the main body 111. The soldering section 122 is received within the passageway 113 and extends through the supporting surface 119 into the recess 114. The FPC 20 forms in the front region a plurality of holes 21 through which the soldering sections 123 of the contacts 12 respectively extend. The shell 13 surrounds the housing 11 and restricts movement of the FPC relative to the housing in the vertical direction. The shell 113 further reinforces the whole connector 10 and enhances shielding effect to the FPC. Notably, a pair of alignment posts (not labeled) formed in the recess 114, extend through the corresponding alignment holes (not labeled) in the FPC 20 so as to prevent backward movement of the FPC relative to the housing 11 in a front-to-back direction. In this embodiment, the shell 13 further includes a pair of mounting ears (not labeled) for securing the connector 10 to an external part (not shown), The assembling method of the electrical connector 10 including the following steps: (1) providing an insulative housing 10 with a main body 111 having a mounting surface 119 thereon, and an oblique/mating section 116 having a mating surface 118 thereon; assembling a plurality of contacts 12 into the housing 10 from the mating surface 118; (3) bending the soldering section 123 of the contacts 12 toward and beyond the supporting surface 119; (4) positioning an FPC 20 upon the supporting surface 119 in the vertical direction with the contacting sections of the contacts 12 extending therethrough; (5) soldering the soldering sections of the contacts with the FPC 20; (6) forwardly assembling and attaching a metallic shell 13 upon the housing 10 for restricting movement of the FPC 20 relative to the housing 10 in a vertical direction: (7) bending the FPC 20 by support of the edge of the shell 113.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector assembly comprising:

an insulative housing defining a main body defining a supporting surface thereon, and a mating section extending forwardly in a front-to-back direction from the main body with a mating surface thereon;

at least one alignment post extending from the supporting surface;

a plurality of contacts retained in the housing, each of said contacts including a front contacting section exposed upon the mating surface, a rear soldering section extending beyond the supporting surface, and a connecting section located between the contacting section and the soldering section;

an FPC (Flexible Printed Circuits) positioned upon the supporting surface and soldered to the soldering sections of the contacts; and a metallic shell attached upon the housing; wherein the alignment post extends through the FPC for preventing movement of the FPC with regard to the housing in said front-to-back direction; and the shell confronts the FPC in a vertical direction perpendicular to said front-to-back direction to restrict movement of the FPC with regard to the housing in the vertical direction.

2. The electrical connector assembly as claimed in claim 1, wherein the soldering section is angled with the contacting section, and the housing and the contacts are configured to allow the contact to be only rearwardly assembled into the housing from the mating surface.

3. The electrical connector assembly as claimed in claim 1, wherein the FPC is bent along a support rear edge of the metallic shell.

4. The electrical connector assembly as claimed in claim 1, wherein the metallic shell forms a frame structure enclosing the housing circumferentially.

5. The electrical connector assembly as claimed in claim 1, wherein the shell forms a notch and the housing forms a block received within the notch and preventing the shell from being withdrawn from the housing backwardly after the shell is forwardly assembled to the housing.

6. The electrical connector assembly as claimed in claim 1, wherein the mating section is oblique to the main body.

7. The electrical connector assembly as claimed in claim 6, wherein said mating surface is directed to an exterior in an oblique direction.

8. The electrical connector assembly as claimed in claim 7, wherein an angle between a direction of the supporting surface and that of the mating surface is less than 90 degrees.

9. A method of making an electrical connector assembly comprising steps of:

(1) providing an insulative housing with a main body having a mating surface thereon, and a mating section extending forwardly, in a front-to-back direction, from the main body with a supporting surface thereon;

(2) assembling a plurality of contacts into the housing with corresponding contacting sections exposed upon the mating surface and the soldering section exposed upon the supporting surface;

(3) positioning an FPC (Flexible Printed Circuits) upon the supporting surface in a vertical direction perpendicular to said front-to-back direction;

(4) soldering the soldering sections to the FPC; and (5) attached a metallic shell to the housing; wherein said shell includes a part confronts the FPC in the vertical direction for restricting movement of the FPC relative to the housing in the vertical direction.

10. The method as claimed in claim 9, wherein said soldering sections are bent to be exposed upon the supporting surface only after the contacts are assembled into the housing.

11. The method as claimed in claim 10, wherein said contacts are rearward assembled into the housing in the front-to-back direction.

12. The method as claimed in claim 11, wherein the mating surface is angled with regard to the supporting surface.

13. The method as claimed in claim 11, wherein said shell is forwardly assembled to the housing, and the housing forms a block preventing rearward movement of the shell with regard to the housing once the shell is assembled to the housing.

14. The method as claimed in claim 9, wherein the shell is assembled to the housing only after the soldering sections soldered to the FPC.

15. An electrical connector comprising:

an insulative housing defining a main body defining a supporting surface thereon for positioning an FPC (Flexible Printed Circuits) thereon, and a mating section extending forwardly in a front-to-back direction from the main body with a mating surface thereon;

at least one alignment post extending from the supporting surface;

a plurality of contacts retained in the housing, each of said contacts including a front contacting section exposed upon the mating surface, a rear soldering section extending beyond the supporting surface, and a connecting section located between the contacting section and the soldering section; and a metallic shell attached upon the housing and having a frame structure surrounding the housing; wherein the housing is configured to allow the contacts to be assembled into the housing only from the mating surface rearwardly from the front-to-back direction; wherein the metallic shell directly confronts the supporting surface in a vertical direction perpendicular to the front-to-back direction.

16. The electrical connector as claimed in claim 15, wherein said housing is configured to allow the shell to be only forwardly assembled thereto along the front-to-back direction.

17. The electrical connector as claimed in claim 16, wherein said housing forms a block to prevent rearward movement of the shell with regard to the housing once the shell is assembled to the housing.

18. The electrical connector as claimed in claim 15, wherein said housing forms a passageway large enough to allow the soldering section of the contact to be bent toward the supporting surface after the contact is inserted into the housing from the mating surface.

19. The electrical connector as claimed in claim 16, wherein the shell only shields a portion of the supporting surface in the vertical direction while exposing the soldering sections of the contacts.

* * * * *